United States Patent [19]

Okano

[11] 3,976,478

[45] Aug. 24, 1976

[54] COPPER ALLOY OF EXCELLENT CORROSION RESISTANCE, MECHANICAL STRENGTH AND CASTABILITY

[75] Inventor: Masao Okano, Suwa, Japan

[73] Assignee: Toyo Valve Company, Ltd., Tokyo, Japan

[22] Filed: Sept. 24, 1975

[21] Appl. No.: 616,313

[30] Foreign Application Priority Data

May 6, 1975 Japan ..... 50-53264

[52] U.S. Cl. ..... 75/156.5

[51] Int. Cl.[2] ..... C22C 9/01

[58] Field of Search ..... 75/156.5, 160, 163, 75/162, 157, 157.5

[56] References Cited

UNITED STATES PATENTS

| | | | |
|---|---|---|---|
| 2,035,415 | 3/1936 | Wilkins | 75/160 |
| 2,075,004 | 3/1937 | Bassett | 75/156.5 |
| 2,231,940 | 2/1941 | Nylander | 75/160 |
| 2,271,969 | 2/1942 | Davis et al. | 75/163 |
| 3,097,093 | 7/1963 | Fox et al. | 75/163 |
| 3,923,500 | 12/1975 | Kitazawa et al. | 75/156.5 |

FOREIGN PATENTS OR APPLICATIONS

| | | | |
|---|---|---|---|
| 41-2521 | 2/1966 | Japan | 75/156.5 |

*Primary Examiner*—W. Stallard

*Attorney, Agent, or Firm*—Armstrong, Nikaido & Wegner

[57] ABSTRACT

A copper alloy which excels in corrosion resistance, mechanical strength and castability and is suitable for the manufacture of valves, cocks and related cast parts. The copper alloy comprises by weight 5.0 – 6.5% aluminum, 0.2 – 0.5% silicon, 0.2 – 0.5% tin, 0.2 – 4.0% zinc, 1.0 – 1.5% lead and 1.0 – 3.0% iron and the rest being composed of copper.

9 Claims, 7 Drawing Figures

COPPER ALLOY OF EXCELLENT CORROSION RESISTANCE, MECHANICAL STRENGTH AND CASTABILITY

BRIEF DESCRIPTION OF DRAWINGS

In the accompanying sheets of drawings, all figures are photomicrographs which substitute for drawings. FIG. 1 and FIG. 4 illustrates the alloy prepared in accordance with this invention while

DETAILED DESCRIPTION OF THE INVENTION

Figure 1:
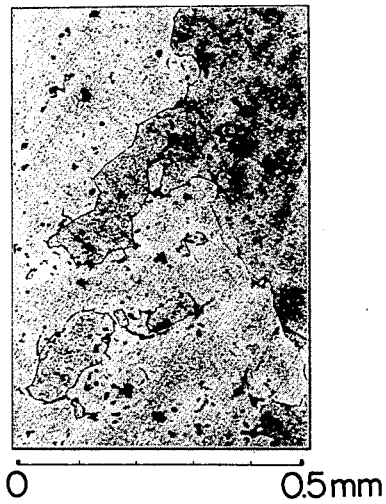

This invention relates to a copper alloy which excels in corrosion resistance, mechanical strength and castability and more particularly to a copper alloy principally comprising copper, aluminum and zinc, with silicon, tin, lead, iron and, if desired, beryllinum added. The copper alloy being excellent in corrosion resistance, mechanical strength and castability, the use of it is highly suitable for the manufacture of valves, cocks and their cast accessories.

The requirements for controlling and processing highly corrosive fluids such as industrial waste water, contaminated sea water, etc. have increased in these days. In most cases, such contaminated fluids have hydrogen ion concentration (hereinafter will be called PH) which is not neutral and contain sulfides. Therefore, the valves, cocks and their accessories which have hitherto been obtained by casting the conventional copper alloys such as bronze, aluminum bronze or brass have very short life expectancy with troubles frequently caused by dezincing and aluminum removing phenomena, penetrant pitting and corrosion cracking.

Heretofor, valves, cocks and their cast accessories have been made from conventionally known alloys such as bronze, aluminum bronze and brass. Of such bronze materials, the sixth class bronze castings of JIS (hereinafter will be called BC 6) have been used most frequently. Although BC 6 castings are relatively good in corrosion resistance and castability, they are not good enough in mechanical strength.

JIS brass castings (hereinafter will be called YBsC) and JIS aluminum bronze casting (will be called ALBC) present problems in terms of corrosion resistance (because of dezincing corrosion and aluminum removing corrosion) while they are relatively good in mechanical strength. In addition to such problems, they present also problems in terms of castability depending on the shapes of the cast products.

It is therefore a general object of this invention to provide a copper alloy which excels in corrosion resistance, mechanical strength and castability and is suitable for the manufacture of valves, cocks and their cast accessories such as elbows, tees, nipples, joints and the like.

Comparing the conventional copper alloys referred to in the foregoing with the copper alloy prepared in accordance with this invention in terms of microscopic structure, the conventional alloys present an $\alpha+\beta$ phase while the copper alloy of this invention presents a pure $\alpha$ phase wherein there appears no $\beta$ phase that causes the dezincing phenomenon (or aluminum removing phenomenon) which is an initial stage of the corrosion of copper alloys.

The inventors of this invention previously proposed a copper alloy of excellent corrosion resistance and machinability containing tin, zinc, lead, and aluminum (Patent Application Laid-Open No. 26619-73); a high strength iron containing copper alloy which is obtained by adding iron to the above stated components and is of excellent corrosion resistance and machinability (Patent Appl. Laid-Open No. 89826-73); an aluminum containing copper alloy which has a high aluminum content and also excels in corrosion resistance and machinability (Pat. Appl. Laid-Open No. 89827-73); and a strong copper alloy which excels in shock resistance and machinability also containing tin, zinc, lead, aluminum, etc. (Patent Appl. Laid-Open No. 89828-73).

These copper alloys show somewhat varied degrees of mechanical strength and corrosion resistance (particularly with respect to aluminum removing corrosion) according as they differ in the range of chemical components. Furthermore, their castability is not always good for cast products of uneven thickness.

In view of such shortcomings, studies and experiments were conducted for improvement in such copper alloys. Then, it has been discovered that a silicon containing copper alloy which is prepared by adding silicon to such alloy components within a specific range excels in corrosion resistance (against aluminum removing corrosion); has great mechanical strength; and has good castability. The copper alloy of the present invention is based on this discovery.

In accordance with this invention, alloys are provided being composed from 5.0 to 6.5 wt.% of aluminum, 0.2 to 0.5 wt.% of silicon, 0.2 to 0.5 wt.% of tin, 0.2 to 4.0 wt.% of zinc, 1.0 to 1.5 wt.% of lead and 1.0 to 3.0 wt.% of iron and the rest being composed of copper. Such alloys are readily obtainable by ordinary melting, casting and machining processes.

The effects of the addition of elements and the reasons for limiting the ranges of their contents will be understood from the following description.

ALUMINUM: 5.0 – 6.5 wt.%

Although the feature of the invented alloy depends on the use of aluminum, the use of it in quantity less than 5 wt.% results in insufficient tensile strength and particularly in insufficient yield strength while elongation increases. Then, with aluminum content exceeding 6.5 wt.%, there will be produced a $\beta$ phase in the $\alpha$ phase which is characteristic of the alloy of this invention. Furthermore, considering the results of experiments, the preferred range of aluminum is from 5.0 to 6.0 wt.%.

SILICON: 0.2 – 0.5 wt.%

Silicon is an element which serves to improve the properties of the invented alloy. A multiplicational effect can be expected from the combined use of silicon with aluminum. Since the zinc equivalent of silicon is greater than that of aluminum, the same effect can be attained with the addition quantity of aluminum restricted to a lesser degree. Furthermore, aluminum forms a strong oxide film of the surface of a molten alloy and the fluidity of the molten metal will be lowered by apparent surface tension. However, this trouble can be eliminated by the addition of silicon. In addition to this, the addition quantity of aluminum can be limited to a specific range. When the addition quantity of aluminum increases the ductility of the alloy of this invention tends to lower. However, the addition of silicon now makes it possible to obtain a desired ductility. The addition of silicon improves the corrosion resistance and the mechanical properties of the invented alloy. It also serves to increase the fluidity of the molten alloy and to prevent hot cracking. However, the addition of silicon in quantity less than 0.2 wt.% is insufficient for attaining such effects while the addition of it in quantity exceeding 0.75 wt.% tends to produce the $\beta$ phase and makes the alloy fragile. Therefore, the upper limit of addition is set at 0.5 wt.% and, considering the results of experiments, the preferred range of addition quantity is set at 0.2 – 0.3 wt.%.

TIN: 0.2 – 0.5 wt.%

The corrosion resistance of the alloy can be increased by the addition of tin. However, with the addition quantity less than 0.2 wt.%, the effect of it will be insufficient while the addition in excess of 0.5 wt.% will cause reduction in mechanical strength and toughness. The upper limit is therefore set at 0.5 wt.%.

ZINC: 0.2 – 4.0 wt.%

Zinc constitutes a principal component of the alloy together with copper and aluminum. Zinc serves to increase the fluidity of the molten alloy. However, an addition quantity of zinc less than 0.2 wt.% is insufficient while an addition quantity in excess of 4.0 wt.% tends to make the alloy fragile though it increases the hardness of the alloy. The upper limit is therefore set at 4.0 wt.%. According to the results of experiments, the preferred range is from 2.0 to 4.0 wt.%.

LEAD: 1.0 – 1.5 wt.%

Lead serves to increase the machinability and compression resistance of the alloy of this invention. However, the quantity of lead less than 1.0 wt.% is insufficient while the quantity of it in excess of 1.5 wt.% lowers the mechanical strength and particularly decreases the shock resistance of the alloy. Thus, the upper limit is set at 1.5 wt.%.

IRON: 1.0 – 3.0 wt.%

Iron serves to micronize the crystals of the alloy of this invention and thus serves to increase mechanical strength, tensile strength and yield strength. However, the use of it in quantity less than 1.0 wt.% is insufficient while quantity in excess of 3.0 wt.% results in a lowered shock resistance. The upper limit is therefore set at 3.0 wt.%. According to the results of experiments, the preferred range is from 1.5 to 2.6 wt.%.

Furthermore, it is advantageous to add beryllium which serves to decrease the oxide film on the surface of the molten alloy for stabilizing the molten alloy and for the improved fluidity thereof. However, it is preferable to limit the addition quantity of beryllium to 0.1 wt.% as addition of it in a greater quantity not only results in gas absorption but also results in the increase of the cost. Therefore, the suitable addition quantity of beryllium is less than 0.1 wt.%.

The feature and the advantages of the alloy of this invention will become more apparent from the following description of preferred embodiments taken in connection with the accompanying drawings, which are photomicrographs showing the $\alpha$ phase, $\alpha + \beta$ phase, aluminum removing corrosion, dezincing corrosion and crystal grains of the alloy of this invention and alloys of comparison examples. The illustrated conditions of corrosion represent the conditions which result from immersion in moving hot spring water of pH 2.8 at 93°C over a period of 30 days.

Figure 2:
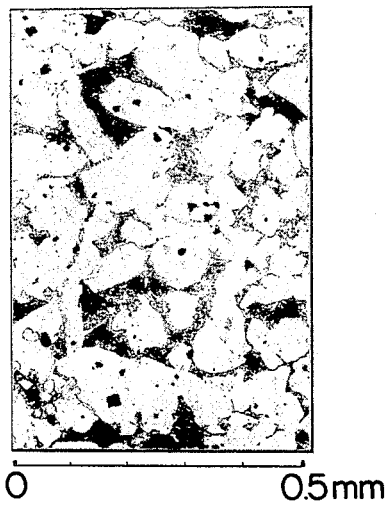
FIGS. 2, 3, 5, 6 and 7 illustrate other alloys as comparison examples.
Figure 3:
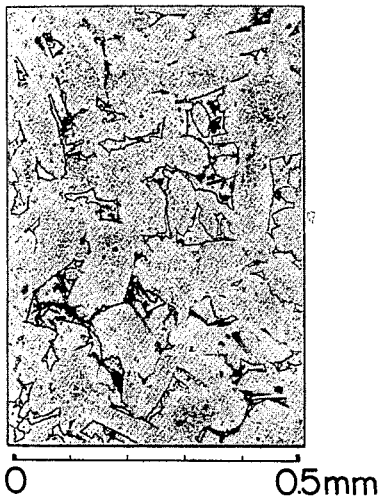

FIG. 1 through FIG. 3 are photomicrographs showing the phase of the invented alloy and those of the comparative examples. FIG. 1 shows the $\alpha$ phase of the invented alloy; FIG. 2 $\alpha + \beta$ phase of an alloy which is not prepared in conformity with the limits of composition set by this invention; and FIG. 3 the $\alpha + \beta$ phase of AlBCl.

Figure 4:
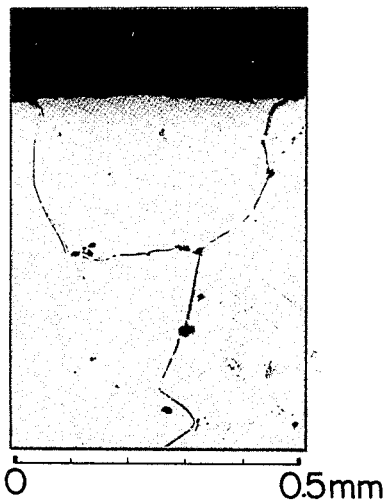
Figure 5:
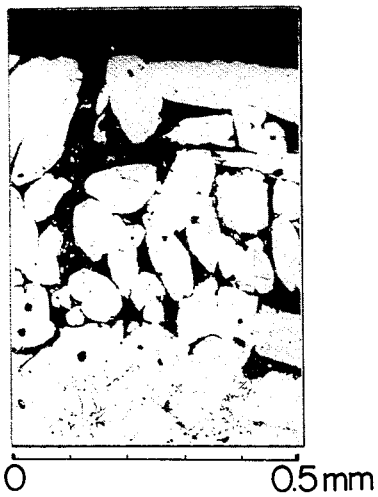
Figure 6:
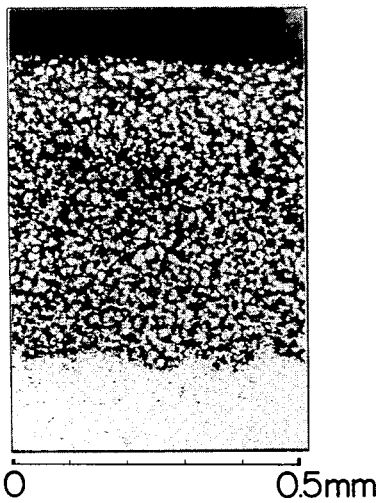
Figure 7:
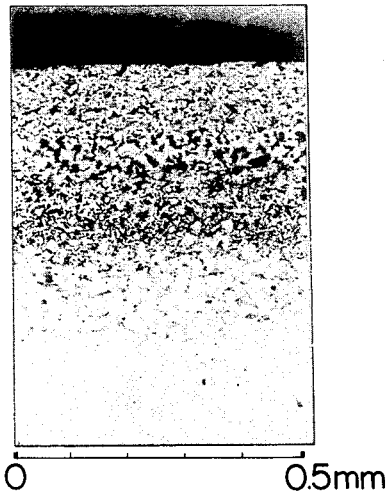

FIGS. 4 through 7 are photomicrographs showing the conditions of the invented alloy and other alloys of comparative examples after corrosion tests, FIG. 4 showing the non-corroded state of the invented alloy; FIG. 5 and FIG. 6 showing the respective aluminum removing corroded states of the alloys prepared deviating from the limits of the composition of this invention and the alloy of ABBD2; and FIG. 7 showing the dezincing corrosion of BsBFD2.

As apparent from these photomicrographs, there is a difference in the microscopic structure between the invented alloy and the conventional ones. The difference shows that the alloy prepared in accordance with this invention excels to a great extent the alloys of the comparison examples including the conventional alloys.

Table 1 shows the embodiment examples of this invention in comparison with examples of other alloys with respect to chemical compositions, mechanical properties and microscopic structures.

Embodiment Examples (Sample No. 1, 3, 5, 7 and 10) and

Comparison Examples (Sample No. 2, 4, 6, 8, 9, 11, 12 and 13)

Table 1

| Sample No. | Examples | Chemical Components (wt.%) | | | | | | | |
|---|---|---|---|---|---|---|---|---|---|
| | | Cu | Al | Si | Sn | Zn | Pb | Fe | Impurities |
| 1 | Embodiment | The rest | 6.0 | 0.2 | 0.5 | 2.0 | 1.0 | 1.5 | |
| 2 | Comparison | " | 6.6 | 0.2 | 0.5 | 2.0 | 1.0 | 1.5 | |
| 3 | Embodiment | " | 6.0 | 0.3 | 0.5 | 2.0 | 1.0 | 1.5 | |
| 4 | Comparison | " | 6.0 | 0.75 | 0.5 | 2.0 | 1.0 | 1.5 | |
| 5 | Embodiment | " | 5.0 | 0.2 | 0.5 | 2.0 | 1.0 | 2.6 | |
| 6 | Comparison | " | 5.0 | 0.2 | 1.1 | 2.0 | 1.0 | 2.6 | |
| 7 | Embodiment | " | 5.0 | 0.2 | 0.5 | 4.0 | 1.5 | 2.5 | |
| 8 | Comparison | " | 5.0 | 0.2 | 0.5 | 2.0 | 3.0 | 1.5 | |
| 9 | Comparison | " | 5.0 | 0.2 | 0.5 | 2.0 | 1.0 | 0 | |
| 10 | Embodiment | " | 5.0 | 0.2 | 0.5 | 2.0 | 1.0 | 2.2 | |
| | | | | | | (Ni) | (Mn) | | |
| 11 | Comparison | 86.6 | 6.0 | — | — | 0.29 | 0.73 | 3.2 | |

Table 1-continued

| | | | | | | | | | |
|---|---|---|---|---|---|---|---|---|---|
| 12 | Comparison | 83.4 | 8.9 | — | 4.5 | 6.0 | 5.6 | (Ni) 0.3 | 0.2 |
| 13 | Comparison | 59.2 | — | — | 0.6 | The rest | 1.3 | 0.1 | |

| Sample No. | Examples | Tensile strength (Kg/mm²) | Mechanical Properties: Elong'n (%) | Yield str'gth (Kg/mm²) | Impact (Kg-m/cm²) | Hardness (HB) | Microscopic structure |
|---|---|---|---|---|---|---|---|
| 1 | Embodiment | 32.5 | 43 | 10.7 | 9.4 | 50.3 | α |
| 2 | Comparison | 32.5 | 42 | 10.4 | 10.6 | 66.8 | α+β |
| 3 | Embodiment | 35.0 | 30 | 12.0 | 5.8 | 62.5 | α |
| 4 | Comparison | 33.5 | 15 | 12.5 | 3.5 | 64.6 | α+β |
| 5 | Embodiment | 38.3 | 31 | 12.1 | 4.3 | 66.8 | α |
| 6 | Comparison | 29.6 | 13 | 13.2 | 2.7 | 79.6 | α |
| 7 | Embodiment | 29.6 | 25 | 13.6 | 3.0 | 86 | α |
| 8 | Comparison | 31.5 | 25 | 10.1 | 3.8 | 58.6 | α |
| 9 | Comparison | 23.4 | 50 | 6.3 | 13.2 | 57 | α |
| 10 | Embodiment | 45.5 | 31 | 13.6 | 5.0 | 64.6 | α |
| 11 | Comparison | 54.7 | 30 | 19.2 | 7.3 | 110 | α+β |
| 12 | Comparison | 27.5 | 27 | 12.5 | 2.7 | 75 | α+β |
| 13 | Comparison | 43.5 | 33 | 30.2 | 3.5 | 121 | α+β |

Notes: No. 11 ALBCl; No. 12 is BC6; No. 13 is a forging brass rod (BsBFD2) of JIS.

All of the alloys of the comparison examples shown in Table 1 are prepared in the form of JIS, B test pieces at a pouring temperature of 1180°C. The test pieces are machined into No. 4 tensile test pieces and No. 3 impact test pieces. For the first through 7th microscopic tests, samples which have undergone the strength tests are used after polishing.

The tendency that there appears a β phase in the microscopic structure when the aluminum and silicon contents are in excess of the composition range of this invention is clearly observed in the comparison examples.

Table 2 shows test pieces which are prepared from the alloys of this invention, a comparison example alloy and alloys BC6, BsBFD2 and ABBD2 by machining them into a size of 14 mm in dia. and 32 mm in length.

Each test piece is immersed in moving hot spring water of pH 2.8 at 93°C and the decrease in their weight due to corrosion is examined.

and the values are indicated showing the results of tests conducted for 10, 20 and 30 days. The degree of erosion, removal of aluminum (and dezincing) measured is converted to values/year.

For comparison, an alloy of composition deviating from that of this invention and samples of BC6, BsBFD2 and ABBD2 are shown in Table 2, because forged products are not porous having high density and their weight decrease due to corrosion is not much as compared with the conventional YBsC and ALBC.

However, Table 2 shows that all of the comparison alloys are inferior to the alloys of this invention in terms of weight decrease due to corrosion and the depth of the aluminum removing (dezincing) corrosion. The results of tests indicate that the alloys obtained in accordance with this invention are excellent in corrosion resistance.

As indicated in Tables 1 and 2, the invented alloy excels in mechanical properties and corrosion resis- Table 2

| Alloys | Chemical components (wt.%): Cu | Al | Si | Sn | Zn | Pb | Fe | Microscopic structure |
|---|---|---|---|---|---|---|---|---|
| Invented alloy | The rest | 5.0 | 0.2 | 0.5 | 2.2 | 1.0 | 3.0 | α |
| " | " | 5.7 | 0.2 | 0.5 | 2.2 | 1.0 | 3.0 | α |
| Comparison alloys: | | | | | | | | |
| Comp. example | The rest | 6.8 | 0.2 | 0.5 | 2.1 | 1.0 | 3.0 | α+β |
| BC6 | 84.6 | — | — | 4.4 | 5.4 | 5.4 | — | α+β |
| BsBFD2 | 59.97 | — | — | 0.6 | the rest (Ni) | 1.4 (Mn) | 0.2 | α+β |
| ABBD2 | 84.40 | 10.90 | — | 0.03 | 1.08 | 0.99 | 2.6 | α+β |

| Alloys | Degree of corrosion (mg/cm²): 10 days | 20 days | 30 days | Al (Zn) removing depth (mm): 10 days | 20 days | 30 days | Conversion to mm/year: Degree of erosion | Al, Zn removing depth |
|---|---|---|---|---|---|---|---|---|
| Invented alloy | 16.86 | 34.23 | 62.31 | None | None | None | 0.83 | None |
| " | 18.05 | 20.73 | 46.28 | " | " | " | 0.63 | " |
| Comparison alloys: | | | | | | | | |
| Comp. example | 12.61 | 18.03 | 49.04 | 0.06 | 0.07 | 0.08 | 0.66 | 0.96 |
| BC6 | 25.75 | 48.24 | 80.71 | None | None | None | 1.09 | None |
| BsBFD2 | 22.82 | 41.26 | 56.42 | 0.12 | 0.22 | 0.39 | 0.95 | 4.20 |
| ABBD2 | 18.79 | 41.38 | 69.77 | 0.02 | 0.07 | 0.12 | 1.18 | 1.44 |

The degree of corrosion is measured in mg/cm² and the depth of removal of aluminum (dezincing) in mm tance compared with other alloys while it equals BC6 in castability. Therefore, with the alloy of this invention employed, cast products of complex shapes can be easily manufactured with much better yield than the conventional corrosion resisting alloys. The invented alloy is therefore suitable for the manufacture of valves, cocks and their cast accessories.

The alloy of this invention being a great improvement over the conventional corrosion resisting alloys, the industrial applications of it will give great advantages.

What is claimed is:

1. A copper alloy of excellent corrosion resistance, mechanical strength and castability comprising by weight 5.0 – 6.5% aluminum, 0.2 – 0.5% silicon, 0.2 – 0.5% tin, 0.2 – 4.0% zinc, 1.0 – 1.5% lead and 1.0 – 3.0% iron, the rest being composed of copper.

2. A copper alloy as defined in claim 1 wherein the aluminum content does not exceed 6.0 wt.%.

3. A copper alloy as defined in claim 1, wherein the silicon content does not exceed 0.3 wt.%.

4. A copper alloy as defined in claim 1 wherein the zinc content is at least 2.0 wt.%.

5. A copper alloy as defined in claim 1 wherein the iron content is at least 1.5 wt.%.

6. A copper alloy as defined in claim 1 wherein the iron content does not exceed 2.6 wt.%.

7. A copper alloy of excellent corrosion resistance, mechanical strength and castability comprising by weight 5.0 – 6.0% aluminum, 0.2 – 0.3% silicon, 0.2 – 0.5% tin, 2.0 – 4.0% zinc, 1.0 – 1.5% lead and 1.5 – 2.6% iron, the rest being composed of copper.

8. A copper alloy of excellent corrosion resistance, mechanical strength and castability comprising by weight 5.0 – 6.5% aluminum, 0.2 – 0.5% tin, 0.2 – 4.0% zinc, 1.0 – 1.5% lead, 1.0 – 3.0% iron and 0.1% or less than 0.1% beryllium, the rest being composed of copper.

9. Valves, cocks and their accessories which are obtained by melting and casting a copper alloy of excellent corrosion resistance, mechanical strength and castability comprising by weight 5.0 – 6.5% aluminum, 0.2 – 0.5% silicon, 0.2 – 0.5% tin, 0.2 – 4.0% zinc, 1.0 – 1.5% lead and 1.0 – 3.0% iron, the rest being composed of copper.

* * * * *